US008181426B2

(12) United States Patent
Tonnigs

(10) Patent No.: US 8,181,426 B2
(45) Date of Patent: May 22, 2012

(54) CLOSING APPARATUS

(75) Inventor: Bodo Tonnigs, Lichtenberg (DE)

(73) Assignee: Ligmatech Automationssysteme GmbH, Lichtenberg (DE)

( * ) Notice: Subject to any disclaimer, the term of this patent is extended or adjusted under 35 U.S.C. 154(b) by 33 days.

(21) Appl. No.: 12/033,427

(22) Filed: Feb. 19, 2008

(65) Prior Publication Data

US 2008/0200322 A1 Aug. 21, 2008

(30) Foreign Application Priority Data

Feb. 20, 2007 (DE) ..... 20 2007 002 459 U

(51) Int. Cl.
*B65B 7/20* (2006.01)

(52) U.S. Cl. ..... 53/376.5; 53/372.4; 53/376.4; 53/377.2; 53/377.4; 53/378.3; 493/128; 493/131

(58) Field of Classification Search ..... 53/372.4, 53/376.3, 376.4, 376.5, 376.7, 377.2, 377.4, 53/378.3; 493/71, 128, 130, 131
See application file for complete search history.

(56) References Cited

U.S. PATENT DOCUMENTS 1,165,695 A * 12/1915 Montgomery ..... 53/376.5
2,095,258 A * 10/1937 Kimball et al. ..... 53/376.5
2,136,901 A * 11/1938 Ferguson ..... 53/525
2,550,516 A 4/1951 Back
3,374,604 A 3/1968 Roesner et al.
3,943,834 A * 3/1976 Vetten ..... 493/164
4,548,593 A * 10/1985 Tisma ..... 493/56
4,650,450 A * 3/1987 Aiuola et al. ..... 493/179
4,785,610 A * 11/1988 Valenti ..... 53/537
5,454,776 A * 10/1995 Ulrich et al. ..... 493/117
5,538,491 A * 7/1996 Owen et al. ..... 493/184
5,839,254 A * 11/1998 Chen ..... 53/377.2
5,863,380 A * 1/1999 Gambetti ..... 156/443
6,279,301 B1 * 8/2001 Corniani et al. ..... 53/458
6,339,914 B1 * 1/2002 Fujikawa et al. ..... 53/565
6,385,950 B1 * 5/2002 Anderson ..... 53/563

* cited by examiner

*Primary Examiner* — Christopher Harmon

(57) ABSTRACT

A Closing apparatus (1) for closing packaging elements, in particular cardboard boxes, comprises conveying device (2) for conveying the packaging elements, a folding device (4) for folding down at least one section of the packaging element concerned, a first closing device (6) for closing at least one section of the packaging element concerned, arranged on a first longitudinal side of the conveying device (2), wherein the closing apparatus further comprises a second closing device (8) for closing at least a section of the packaging elements concerned that is mounted on a second longitudinal side of the conveying device (2) opposite the first longitudinal side of the conveying device (2).

5 Claims, 2 Drawing Sheets

Stand der Technik

CLOSING APPARATUS

CROSS-REFERENCE TO RELATED APPLICATIONS

The present application claims the benefit of German Utility Model Application No. D20 2007 002 459.2, filed Feb. 20, 2007, which is hereby incorporated by reference in its entirety.

FIELD OF THE INVENTION

The invention relates to a closing apparatus for closing packaging elements, in particular cardboard boxes.

PRIOR ART

Panel or bar-shaped workpieces such as furniture fronts, carcass parts or the like are generally packed for transportation in cardboard boxes or other suitable containers. To this end, cardboard folded into a container with an open lid is transported on a line and filled with the workpieces. In order to ensure adequate filling capacity, the loading devices are often provided on either longitudinal side of the line and can operate in an alternating cycles. The containers are, in this case, loaded from the longitudinal side opposite the open lid.

A design of this nature has been distributed by the applicant in conjunction with the VKV 700 stationary box closing machine, for instance. FIG. 2 shows a schematic plan view of the VKV 700 stationary box closing machine. The containers arriving from the line (arrow at left in FIG. 2) are rotated by a rotating station 14 as necessary so that the open lid is facing upwards in FIG. 2. The containers are then passed to a conveying device 2 for the closing apparatus 1 itself. There the lid is first folded by a lid folding device 4 in order to then make a longitudinal and transverse closure for the lid.

Although the known closing apparatus has proved its worth in practice, constantly increasing requirements on throughput speed and the capacity of the closing apparatus are being made.

SUMMARY OF THE INVENTION

It is therefore the object of the present invention to provide a closing apparatus of the type mentioned above which has an enhanced throughput speed or capacity, without the overall design becoming more complex.

This object is achieved according to the invention by a closing apparatus for closing packaging elements, in particular cardboard boxes, comprising a conveying device for conveying the packaging elements, a folding device for folding down at least one section of the packaging element concerned, a first closing device for closing at least one section of the packaging element concerned, arranged on a first longitudinal side of the conveying device, wherein the closing apparatus further comprises a second closing device for closing at least a section of the packaging elements concerned that is mounted on a second longitudinal side of the conveying device opposite the first longitudinal side of the conveying device.

The invention is based on the recognition that the throughput speed or the capacity of the known closing apparatus is substantially impaired by the upstream rotating station. This prevents the containers passing through the machine briskly and interrupts the operation of the equipment as a whole. Given this context, it is proposed according to the invention that the closing apparatus further comprises a second closing device for closing at least one section of the packaging elements concerned that is located on a second longitudinal side of the conveying device opposite the first longitudinal side of the conveying device.

In this way it will be possible to dispense completely with any rotating station or the like in the closing apparatus according to the invention, so that the containers can pass briskly and without interruption from the transport line to the conveying device in the closing apparatus. This allows the throughput speed or the capacity of the closing device in accordance with the invention to be significantly increased. At the same time, the operation of the apparatus according to the invention is less susceptible to faults and malfunctions overall. At the same time, omitting the rotating station means that the design of the apparatus according to the invention is no more complex than before.

According to a development of the invention, it is proposed that the folding device be arranged so as to execute folding operations around a plurality of folding axes. In this way, the folding device can be adjusted to the current position of the container lid briskly and without problem so that it is not necessary to provide a plurality of folding devices and a speedy and uninterrupted operation of the closing apparatus according to the invention is the result. It is especially preferred here that the folding device comprises at least one folding element that is rotatable around an axis extending substantially perpendicular to a conveying plane of the conveying device. This results in a particularly simple design of the device.

The first and the second closing device can be configured differently within the scope of the present invention and comprise, for example, stationary closing elements. In view of a secure and precise closing procedure it has, however, been found advantageous that, according to a development of the invention, the first and/or second closing device each have at least one movable closing element which is preferably movable substantially perpendicularly to a transport plane of the conveying device. It must be noted here that at least one movable closing element can also be movable in other directions in addition to the movement perpendicular to the conveying plane of the conveying device mentioned, for example in a plane parallel to the conveying plane of the conveying device in order to achieve a particularly effective closing pressure on the sections to be closed.

In addition to this, it is proposed in accordance with a development of the invention that the first and/or second closing device each comprises at least one glue application unit, which is preferable arranged in a stationary position so as to achieve a particularly simple design.

The present invention also differs in essence from the prior art referred to above in that, in accordance with a development of the invention, a loading device can be mounted directly on the conveying device for the folding device, i.e. that no rotating table or the like is interposed between the filling device and the conveying device.

DETAILED DESCRIPTION OF PREFERRED EMBODIMENTS

Preferred embodiments of the present invention are described below in detail with reference to the accompanying drawings.

Figure 1:
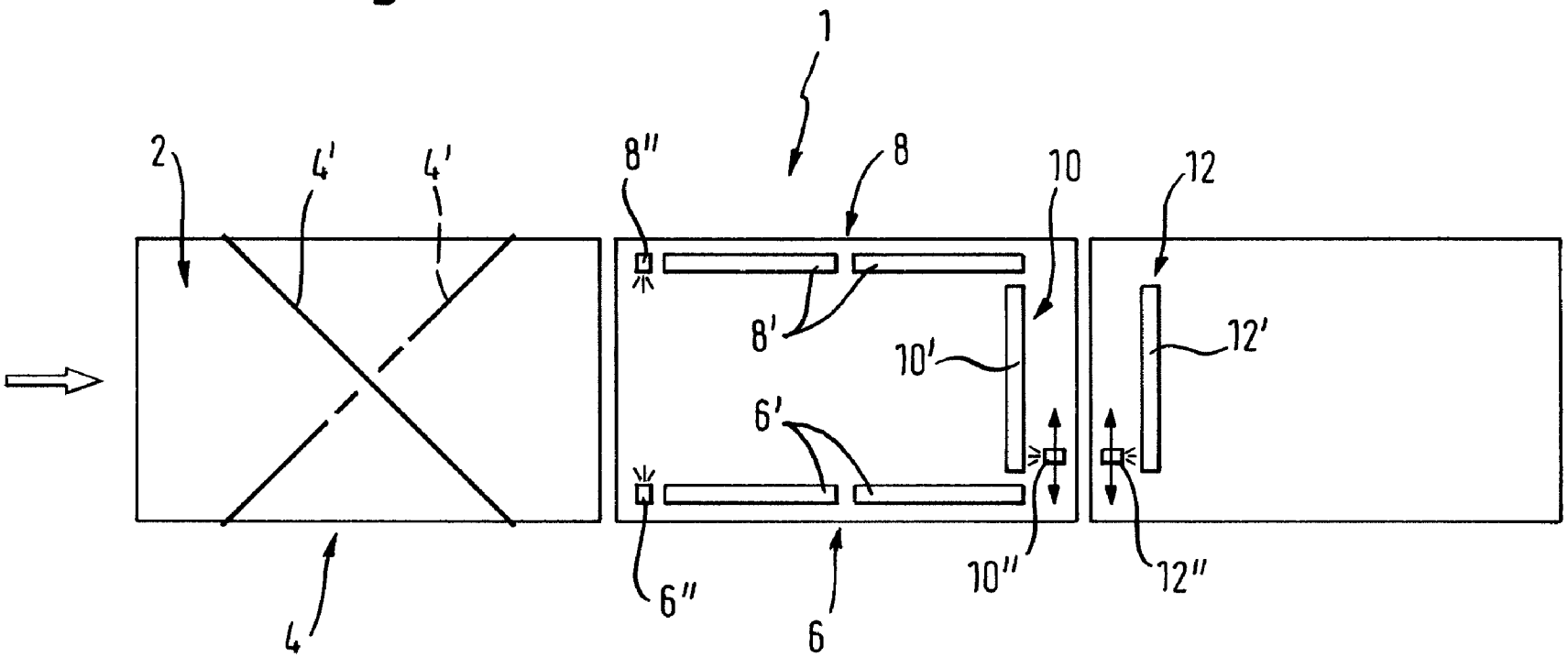
FIG. 1 shows a schematic plan view of a closing apparatus as a preferred embodiment of the present invention.
Figure 2:
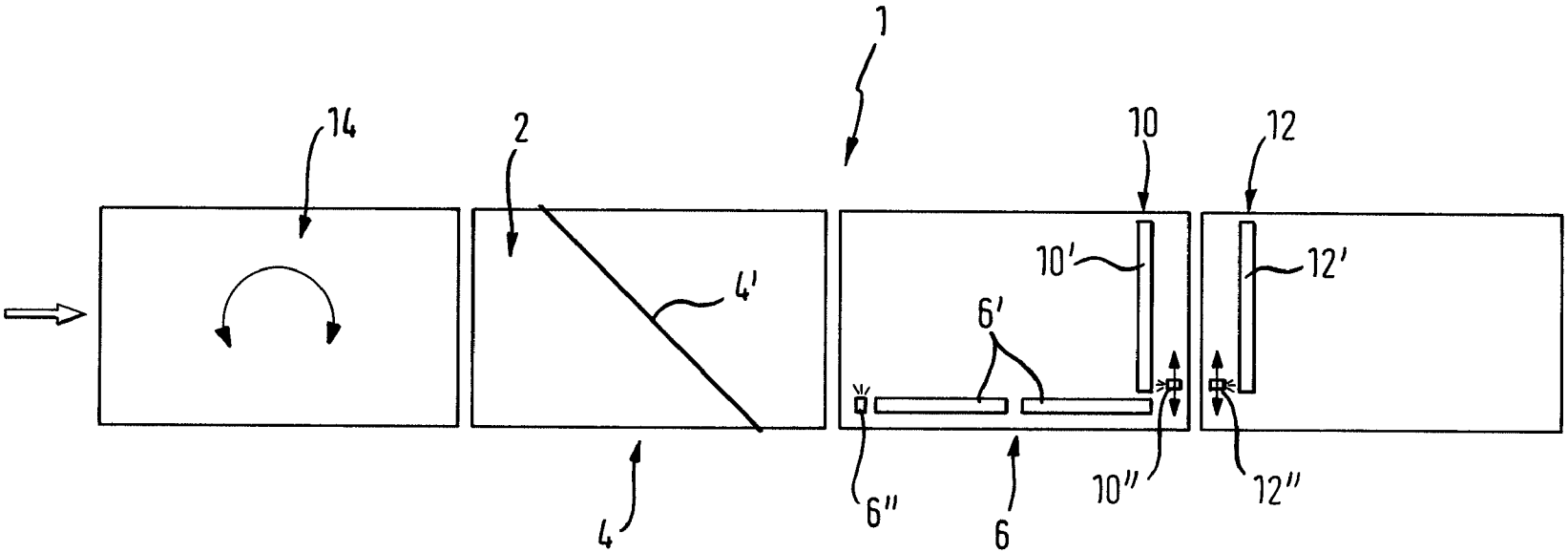
FIG. 2 shows a schematic plan view of a closing apparatus from the prior art.

A closing apparatus 1 as a preferred embodiment is shown in schematic plan view in FIG. 1. The closing apparatus is used to close containers which may, for example, be made of cardboard and filled with workpieces, such as panel workpieces as are found in the furniture industry. Although the containers to be closed are not shown in FIG. 1, these may, for example, be designed such that they comprise a bottom box with a lid arranged to fold onto it which for its part possesses tabs which are designed to be positioned against the side of the bottom box to close the container.

The closing apparatus 1 first comprises a conveying device 2 for conveying the packaging elements, for example a roller conveyor or belt conveyor. The conveying device 2 in the present embodiment is here shown in three parts, although it may also comprise a single continuous conveyor or even a greater number of part conveying devices.

Above the conveying device 2 mounted first in the direction of throughput (from left to right in FIG. 1, indicated by an arrow) there is a folding device 4 for folding down at least one section of the appropriate packaging element. The folding device 4 comprises in the present embodiment a folding element 4' that is rotatable around an axis extending essentially perpendicular to the conveying plane of the conveying device 2 (an axis extending perpendicularly to the plane of the drawing in FIG. 1). In this way the folding device 4 can execute folding processes around a plurality of folding axes, wherein the folding axes in this case coincide with each of the directions in which the folding element 4 extends.

The actual closing area of the closing apparatus follows the folding device 4. Here a first closing device 6 for closing at least one section of the packaging element concerned is arranged on a first longitudinal side of the conveying device 2 (bottom in FIG. 1). On the opposing longitudinal side of the conveying device 2 (top in FIG. 1) a second closing device 8 is further mounted for closing at least one section of the packaging element concerned.

The two closing devices 6, 8 are similarly designed in the present embodiment and each have two movable closing elements 6', 8', which are movable both in a direction substantially perpendicular to the conveying plane of the conveying device 2 and also parallel with this conveying plane in the direction towards the packaging element to be closed in each case. Furthermore, glue application units 6", 8" are mounted in fixed positions upstream of each of the closing elements 6', 8'. It should be noted, however, that the first and the second closing device 6, 8 may also be designed in a plurality of other ways within the scope of the present invention.

Furthermore, the closing apparatus 1 comprises a third and a fourth closing device 10, 12 provided for what is known as the narrow side closure of the packaging elements and each comprising a movable closing element 10', 12' corresponding to the above closing elements 6', 8'. Furthermore the third and the fourth closing devices 10, 12 each possess a glue application unit 10", 12" which may be moved transverse to the conveying device 2 (in the direction of the arrows shown in FIG. 1).

Finally, the closing apparatus according to the invention may have, although not shown in FIG. 1, a filling device, for example in the form of a bent arm robot or a loading portal, by means of which the workpieces to be packed or the like may be placed in the packaging elements to be closed. The filling device can, to this end, be mounted on a section of the conveying device 2 upstream of the folding device.

The closing apparatus 1 according to the invention may be operated as follows, for instance. The packaging elements or containers to be closed are loaded with the workpieces to be packed upstream of the folding device 4 on a section of the conveying device 2 that is not illustrated and conveyed in the direction of transport (from left to right in FIG. 1). The closing apparatus 1 adjusts the folding element 4' of the folding device 4 to one of the two positions shown in FIG. 1 depending on the arrangement of an open lid of the approaching packaging element. The packaging element then passes the folding element 4' and is thereby folded in such a way that the lid lies against the bottom box so that the bottom box is closed, while three tabs of the lid stand out partly horizontally.

The packaging element is now transported to the area between the two closing devices 6 and 8 and then has the glue applied by the corresponding glue application unit 6" or 8" to the side at which a tab that is to be closed is projecting horizontally. The conveying device 2 is then halted so that now the corresponding closing elements 6' or 8' can be moved so that the tab that is still projecting horizontally is folded down and closed. Additionally in this position, the leading narrow side of the packaging element has glue applied to it by glue application unit 10" upon which the closing element 10' also closes the tab concerned.

The packaging element is then further transported by the conveying device 2 and finally halted so that the glue application unit 12' can apply glue to the trailing narrow face of the packaging element so that finally closing element 12' can close the third horizontally projecting tab of the packaging element. This concludes the packaging process and the packaging element can be transported away.

The invention claimed is:

1. A closing apparatus for closing a packaging element comprising:

a conveying device for conveying the packaging element;

a folding device for folding down at least one section of the packaging element, wherein the folding device comprises at least one folding element that is rotatable around an axis extending essentially perpendicular to a conveying plane of the conveying device;

a first closing device for closing at least one section of the packaging element, mounted on a first longitudinal side of the conveying device, a second closing device mounted on a second longitudinal side of the conveying device opposite the first longitudinal side of the conveying device for closing at least a section of the packaging element, and wherein the first and second closing devices are moveable in a direction substantially perpendicular to the conveying plane of the conveying device; and wherein at least one of the first and second closing devices comprise at least one glue application unit which is mounted in a fixed position relative to at least one of the first and second closing devices.

2. The closing apparatus according to claim 1, wherein the folding device is arranged so as to execute folding operations around a plurality of folding axes.

3. The closing apparatus according to claim 1, wherein the first and/or second closing device comprise at least one movable closing element which is movable substantially perpendicular to a transport plane of the conveying device.

4. The closing apparatus according to claim 2, wherein the first and/or second closing device comprise at least one movable closing element which is movable substantially perpendicular to a transport plane of the conveying device.

5. The closing apparatus according to any one of the preceding claims, wherein the first and/or second closing device comprises at least one movable closing element which is movable substantially parallel to a transport plane of the conveying device.

* * * * *